US007370379B2

(12) United States Patent
Zheng

(10) Patent No.: US 7,370,379 B2
(45) Date of Patent: May 13, 2008

(54) FOLDABLE INFLATABLE FURNITURE

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 274 days.

(21) Appl. No.: 11/222,051

(22) Filed: Sep. 7, 2005

(65) Prior Publication Data

US 2007/0061977 A1 Mar. 22, 2007

(51) Int. Cl.
*A47C 27/08* (2006.01)

(52) U.S. Cl. ..... 5/655.3; 5/654; 5/657; 5/722; 297/452.41

(58) Field of Classification Search ..... 5/706, 5/710–712, 722, 723, 655.3; 297/440.12, 297/440.13, 452.41
See application file for complete search history.

(56) References Cited

U.S. PATENT DOCUMENTS

| | | | | |
|---|---|---|---|---|
| 1,324,009 | A | 12/1919 | Hope | |
| 1,648,373 | A | 11/1927 | Vilas | |
| 2,620,493 | A | 12/1952 | Brelsford | |
| 2,623,574 | A * | 12/1952 | Damsch | 297/111 |
| 3,751,741 | A | 8/1973 | Hendry | |
| 3,798,686 | A | 3/1974 | Gaiser | |
| 4,092,750 | A | 6/1978 | Ellis | |
| 4,575,884 | A | 3/1986 | Jamerson et al. | |
| 4,604,765 | A | 8/1986 | Shultz | |
| 4,757,832 | A | 7/1988 | Russell | |
| 4,856,131 | A | 8/1989 | Mills | |
| 4,923,247 | A * | 5/1990 | Malmstrom | 297/4 |
| 4,972,533 | A | 11/1990 | Brown | |
| 5,005,236 | A | 4/1991 | Hutchinson | |
| 5,421,045 | A | 6/1995 | Bowen | |
| 5,471,687 | A | 12/1995 | Vierra | |
| 5,528,779 | A | 6/1996 | Lee et al. | |
| 5,548,858 | A | 8/1996 | Shoa | |
| 5,553,339 | A | 9/1996 | Thomas | |
| 5,560,056 | A * | 10/1996 | Tai | 5/120 |
| 5,640,725 | A | 6/1997 | Ando et al. | |
| 5,735,003 | A | 4/1998 | Judge | |
| 5,740,565 | A | 4/1998 | McDade | |
| 6,042,186 | A * | 3/2000 | Kojic et al. | 297/452.41 |
| 6,128,794 | A | 10/2000 | Pariseau | |
| 6,321,400 | B1 | 11/2001 | Guilino | |
| 2002/0078501 | A1 | 6/2002 | Lamke | |
| 2002/0104162 | A1 | 8/2002 | Stewart | |
| 2005/0099054 | A1* | 5/2005 | McCarthy et al. | 297/452.41 |
| 2006/0163935 | A1* | 7/2006 | Harris | 297/452.41 |

* cited by examiner

*Primary Examiner*—Michael Trettel
(74) *Attorney, Agent, or Firm*—Raymond Sun

(57) ABSTRACT

An inflatable item has a body. The body has a chamber therein, and defines an outer edge. An inlet is provided on the body and communicates with the chamber. A groove is cut from the outer edge of the body and extends for a depth into the body. A fold line extends from the outer edge to a portion of the groove.

14 Claims, 14 Drawing Sheets

FOLDABLE INFLATABLE FURNITURE

BACKGROUND OF THE INVENTION

1. Field of the Invention

The present invention relates to inflatable furniture, and in particular, to inflatable furniture that can be easily and conveniently folded to a smaller size both for storage and for use.

2. Description of the Prior Art

Portable furniture has become very popular in recent times. For example, inflatable mattresses, sleeping bags, sleeping mats, futons and similar bed-like products are commonly used in homes, and in outdoor activities such as camping. Inflatable seats and sofas are often found in homes, and are commonly used by children.

These conventional inflatable furniture items are typically provided in the form of one or more water-impervious and air-impervious bodies having chambers that is/are inflated for use. When it is desired to store these items, the chamber (s) is deflated into a flattened form, and then folded or rolled up so that the resulting chamber is very small when compared to the fully-inflated chamber.

Unfortunately, inflating and deflating the chamber(s) can be very time-consuming if the user does not have access to a conventional electric pump that is capable of quickly inflating and deflating the chamber(s). For example, an inflatable seat that is taken by the user to an outdoor environment (such as an outdoor performance, a camping trip, or the beach) often assumes a large and bulky configuration when it is fully inflated. The user would need to carry an electric pump with the inflatable seat if the user wants to (i) quickly inflate the seat at the desired location, and (ii) quickly deflate the seat when it is time to leave the desired location. Otherwise, if the user were required to use a manual hand pump to inflate the inflatable seat, the inflation of the chamber(s) can take a long time. In addition, trying to deflate the inflatable chair by merely pressing on the valve at the air inlet and squeezing the chamber(s) is also time-consuming, and frustrating.

Thus, there still remains a need to provide inflatable furniture that overcomes the drawbacks described above.

SUMMARY OF THE DISCLOSURE

It is an object of the present invention to provide inflatable furniture that is convenient to use, to store and to transport.

In order to accomplish the objects of the present invention, the present invention provides an inflatable item having a body. The body has a chamber therein, and defines an outer edge. An inlet is provided on the body and communicates with the chamber. A groove is cut from the outer edge of the body and extends for a depth into the body. A fold line extends from the outer edge to a portion of the groove. The fold line divides the body into separate sections. The body assumes a planar configuration when fully inflated, and the body assumes a folded configuration when the separate sections are folded about the fold line. A releasable engagement mechanism can be provided to secure the body in the folded configuration.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides inflatable furniture items that are configured so that they do not need to be deflated for storage or transportation. In particular, the furniture items according to the present invention can assume a generally planar configuration even while they are fully inflated. The furniture items can be easily transported and stored while in this planar configuration. As a result, the user can inflate the furniture item anywhere the user desires, and does not need to deflate the furniture item when it is moved around or stored.

Figure 1:
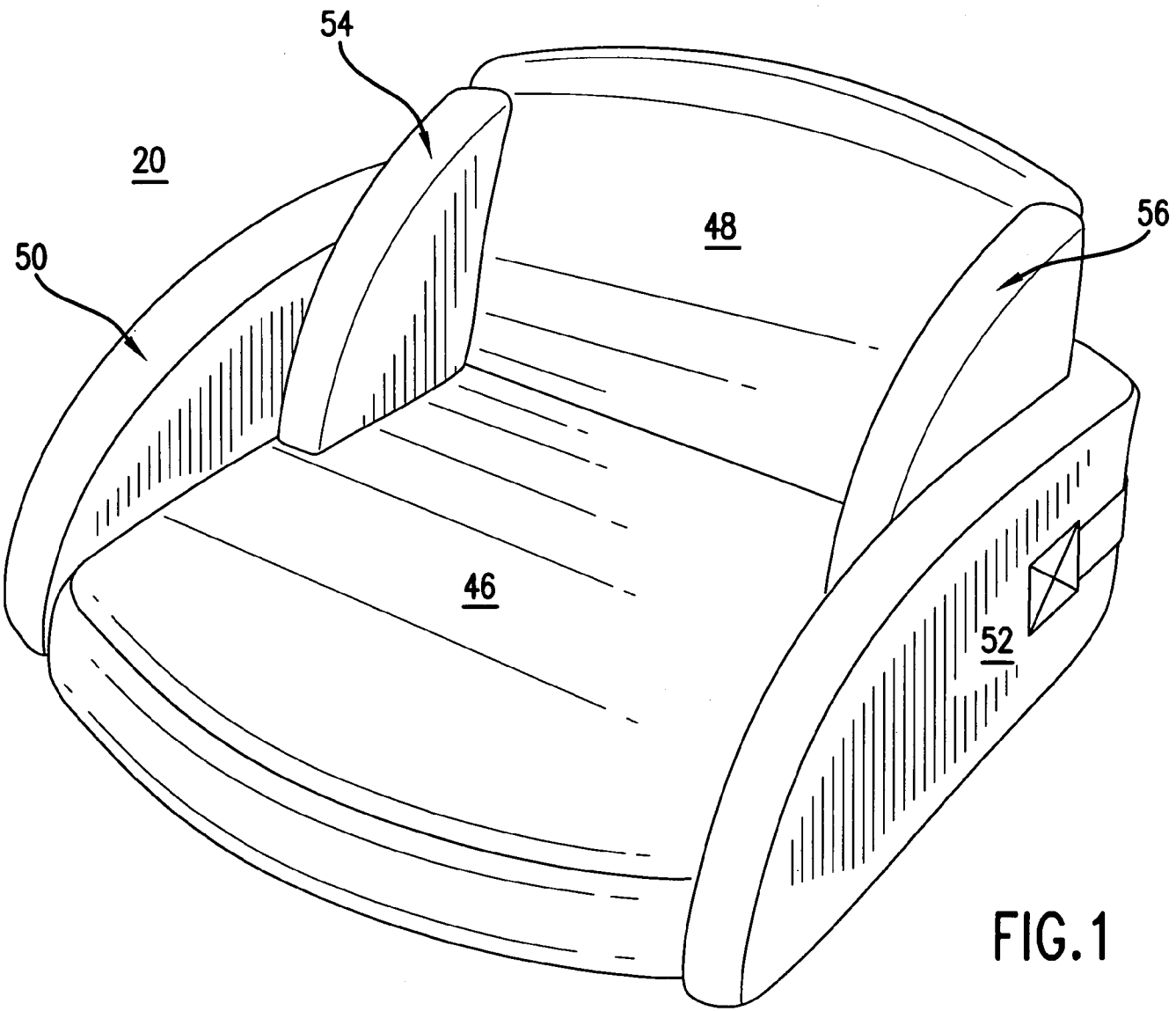
FIG. 1 is a front perspective view of an inflatable seat according to one embodiment of the present invention shown in the assembled position.
Figure 2:
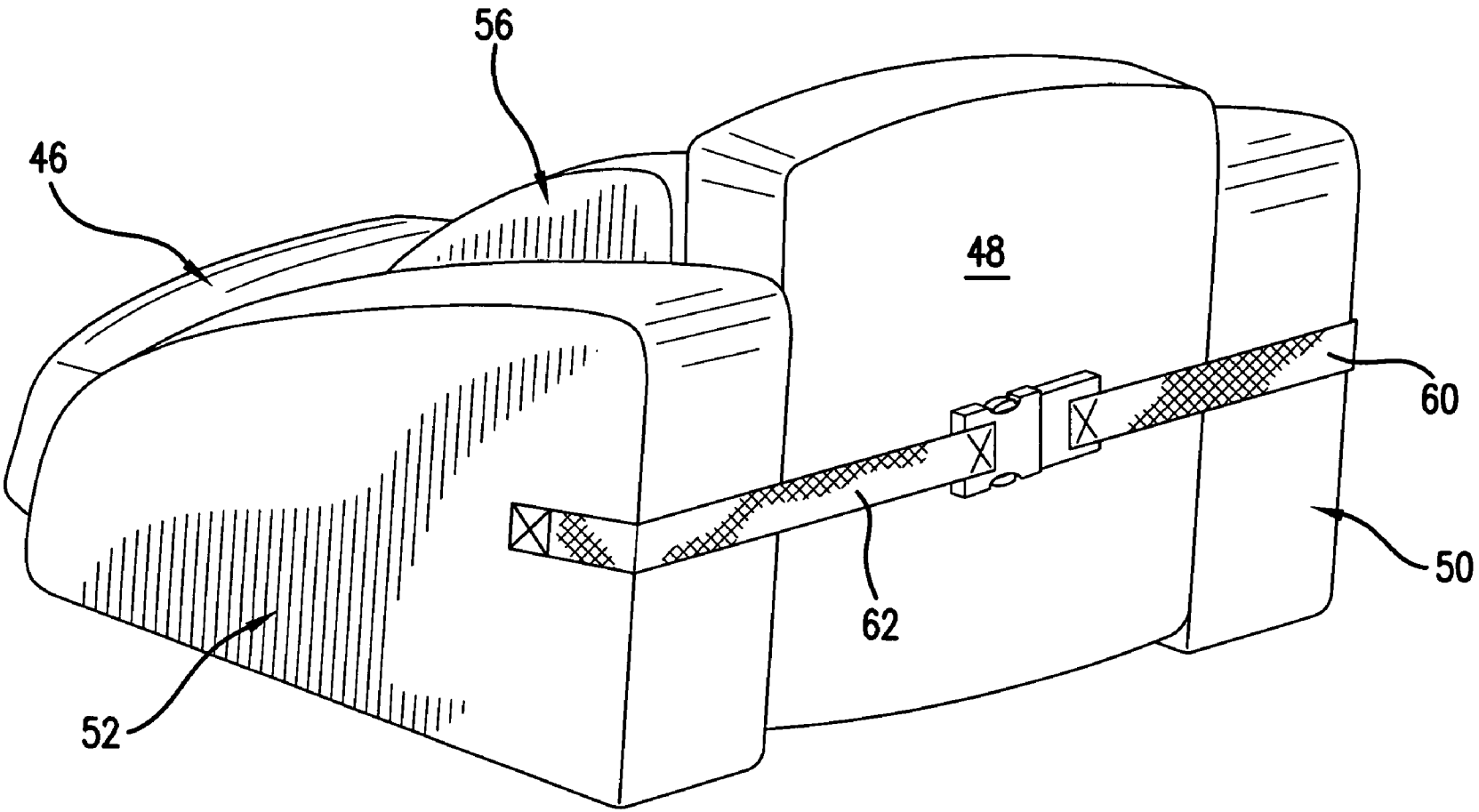
FIG. 2 is a rear perspective view of the inflatable seat of FIG. 1 shown in the assembled position.
Figure 3:
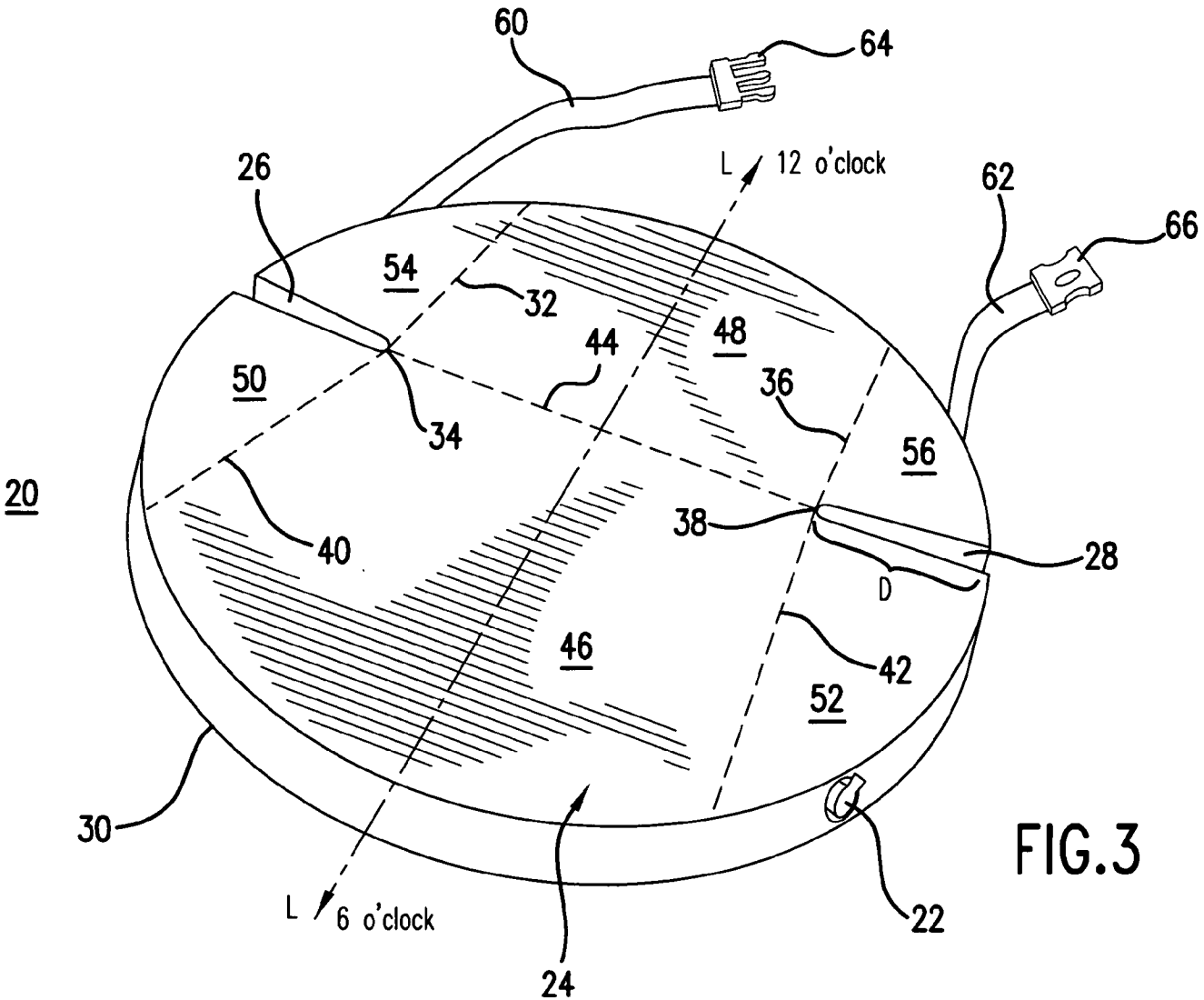
FIG. 3 is a perspective view of the inflatable seat of FIG. 1 shown fully inflated in a disassembled position.

FIGS. 1-3 illustrates an inflatable furniture 20 according to one embodiment of the present invention. Even though the furniture 20 is illustrated as being embodied in the form of a seat, it will be appreciated by those skilled in the art that the principles of the present invention can be applied to other inflatable furniture items as well.

The seat 20 is defined by a body 24, with the body 24 made from any known inflatable material (e.g., PVC) that has at least one interior chamber for receiving air or water that is introduced through an inlet 22. The material is preferably impervious to water and air. As best shown in FIG. 3, the body 24 assumes a generally planar configuration when the body 24 is fully inflated. In the position shown in FIG. 3, the body 24 is fully inflated but disassembled. In this disassembled position of FIG. 3, the body 24 is generally circular, with two opposing grooves 26 and 28 cut from the outer or circumferential edge 30 of the body 24. The depth D of each groove 26, 28 can be varied depending on the desired shape and configuration of the eventual seat 20 that is to be formed (as shown in FIGS. 1 and 2). In addition, the grooves 26, 28 can be positioned at about the 9:30 o'clock and 2:30 o'clock positions along the circumferential edge 30 with respect to the longitudinal center line L-L shown in FIG. 3 that extends through the 12:00 o'clock and 6:00 o'clock positions. The location of the grooves 26, 28 along the circumferential edge 30 can be varied depending on the desired shape and configuration of the eventual seat 20 that is to be formed (as shown in FIGS. 1 and 2).

A first fold line 32 is provided on the body 24 from the edge 30 to the inner end 34 of the groove 26. Similarly, a second fold line 36 is provided on the body 24 from the edge 30 to the inner end 38 of the groove 28. The two fold lines 32, 36 can be symmetrical to each other about the longitudinal line L-L, and can be parallel to each other. A third fold line 40 is also provided on the body 24 from the edge 30 to the inner end 34 of the groove 26. Similarly, a fourth fold line 42 is provided on the body 24 from the edge 30 to the inner end 38 of the groove 28. The two fold lines 40, 42 can also be symmetrical to each other about the longitudinal line L-L. In addition, the fold lines 32 and 40 both extend from the inner end 34 of the groove 26 to opposing portions of the circumferential edge 30, and the fold lines 36 and 42 both extend from the inner end 38 of the groove 28 to opposing portions of the circumferential edge 30. The fold lines 40 and 42 can be co-linear with the fold lines 32 and 36, respectively, or the fold lines 40 and 42 can extend from an angle with respect to the fold lines 32 and 36, respectively. A fifth fold line 44 extends from the inner end 34 to the inner end 38, and can be perpendicular to the longitudinal line L-L. Thus, the fold line 44 can be co-linear with the grooves 26 and 28.

The grooves 26, 28, the circumferential edge 30, and the fold lines 32, 36, 40, 42, 44 divide the body 24 into the following sections: (i) a base section 46 which is defined by the fold lines 40, 44, 42 and the edge 30, (ii) a back rest section 48 which is defined by the fold lines 32, 44, 36 and the edge 30, (iii) a first arm rest section 50 which is defined by the groove 26, the fold line 40 and the edge 30, (iv) a second arm rest section 52 which is defined by the groove 28, the fold line 42 and the edge 30, (v) a first support section 54 which is defined by the groove 26, the fold line 32 and the edge 30, and (vi) a second support section 56 which is defined by the groove 28, the fold line 36 and the edge 30.

Each fold line 32, 36, 40, 42, 44 can be formed by heat sealing the material of the body 24 along the location of the respective fold line 32, 36, 40, 42, 44. The heat seal can extend along the entire fold line 32, 36, 40, 42, 44, or along most (but not all) of the fold line 32, 36, 40, 42, 44. For example, if it is desired to provide each section 46, 48, 50, 52, 54 and 56 with a separate chamber that is inflated through separate air inlets, then the heat seal can extend along the entirety of each of the fold lines 32, 36, 40, 42, 44, thereby sealing each chamber from each adjacent chamber. On the other hand, if it is desired to provide only one inlet (e.g., 22) to inflate all the sections 46, 48, 50, 52, 54 and 56 (i.e., so that the entire body 24 defines a single chamber), then the heat seal can extend along a portion of, but not the entirety of, each of the fold lines 32, 36, 40, 42, 44 so as to define internal openings between sections. As a result, air can pass from one section into another section via these internal openings. The body 24 can be folded along the respective fold line 32, 36, 40, 42, 44. Since the heat seal extends along most or all of each fold line 32, 36, 40, 42, 44, these fold lines 32, 36, 40, 42, 44 allow the adjacent sections to be easily folded about the respective fold line, with the fold line functioning as a pivot hinge.

The grooves 26 and 28 function as separators for adjacent sections. For example, the groove 26 separates the sections 50 and 54, and the groove 28 separates the sections 52 and 56, so that these adjacent sections can be folded away from each other.

An end of a first strap 60 is attached to the outer surface of the section 50, and an end of a second strap 62 is attached to the outer surface of the section 52. Each strap 60 and 62 has a buckle member 64 and 66, respectively, that can be fastened to secure the straps 60, 62 together.

Referring now to FIGS. 1-3, the fully inflated body 24 that is shown in FIG. 3 can be assembled into the seat 20 by first folding the sections 54 and 56 upwardly about the fold lines 32 and 36, respectively. Second, the section 48 is folded upwardly about the fold line 44. Third, the sections 50 and 52 are folded upwardly about the fold lines 40 and 42, respectively. At this time, the body 24 will have been folded to assume the configuration shown in FIGS. 1 and 2. The buckle members 64 and 66 can be fastened to each other behind the section 48 to secure the body 24 in the desired seat configuration 20. In this configuration, the sections 54 and 56 are folded inwardly towards the seating area of the seat 20. The user can then use the seat 20 in a conventional manner.

When it is desired to store or transport the seat 20, the user merely releases the buckle members 64, 66, and folds the sections 48, 50, 52, 54 and 56 downwardly about the respective fold lines 44, 40, 42, 32 and 36 until the body 24 assumes the planar configuration shown in FIG. 3, where the body 24 can be easily and conveniently transported or stored.

Figure 4:
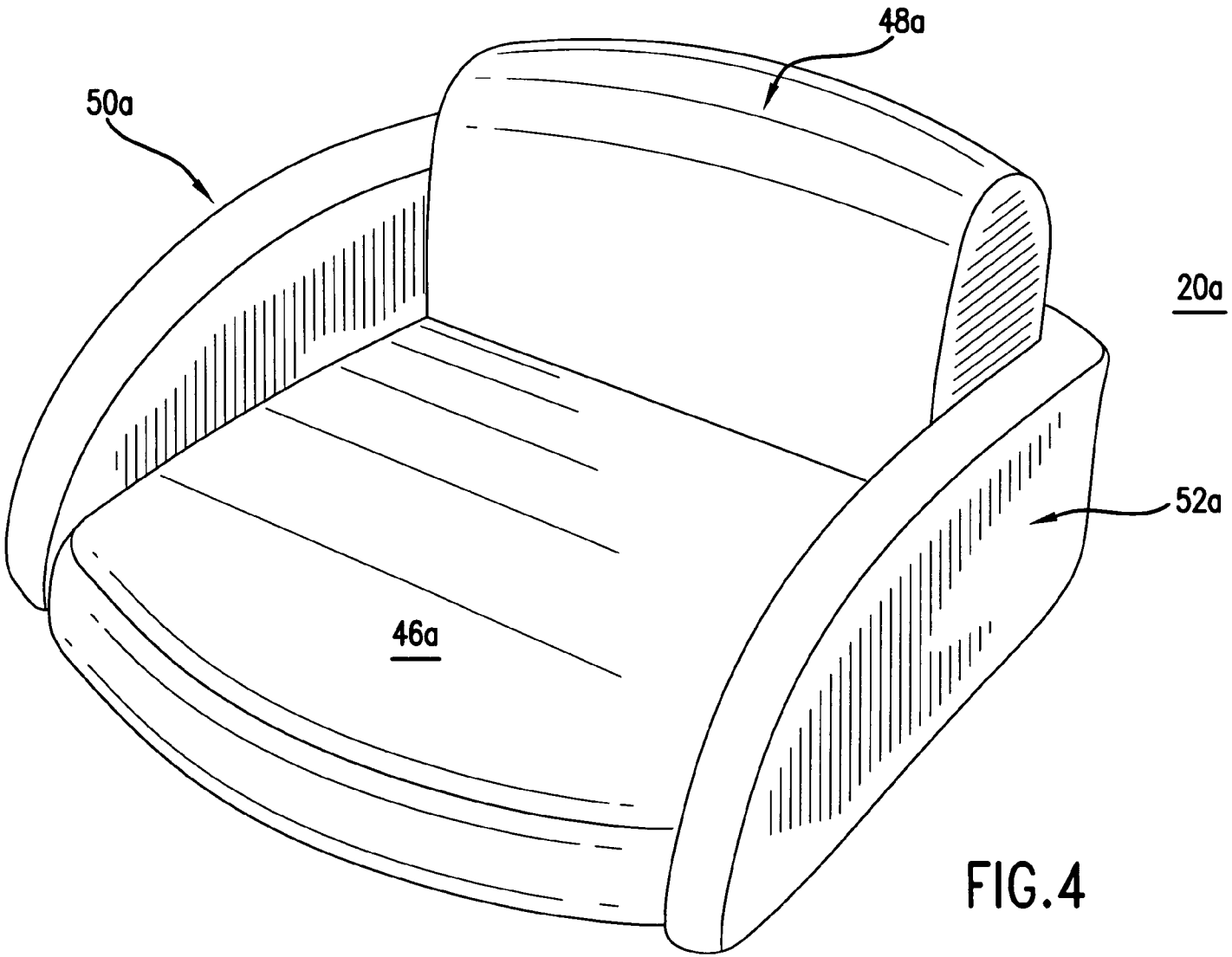
FIG. 4 is a front perspective view of an inflatable seat according to another embodiment of the present invention shown in the assembled position.
Figure 5:
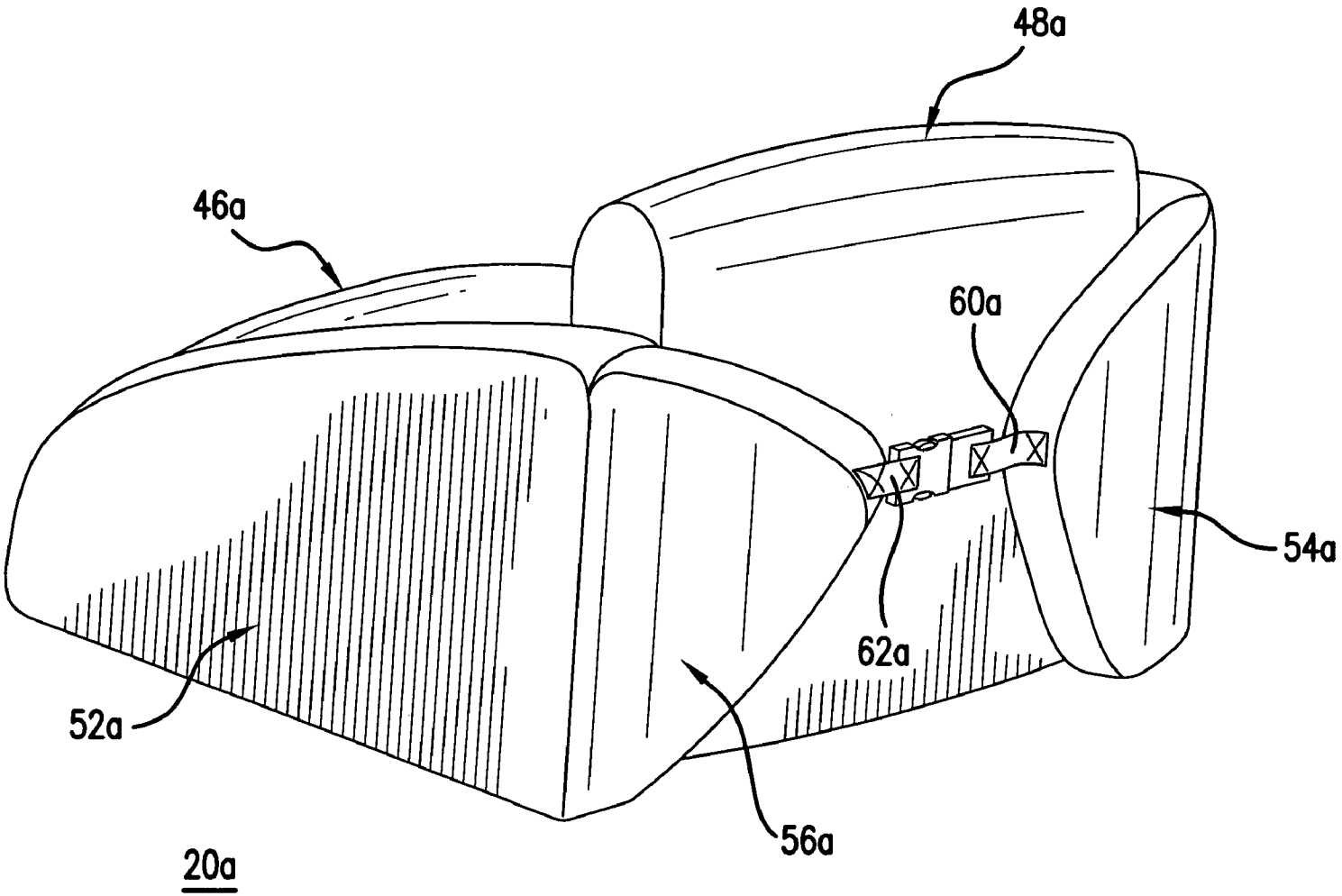
FIG. 5 is a rear perspective view of the inflatable seat of FIG. 4 shown in the assembled position.
Figure 6:
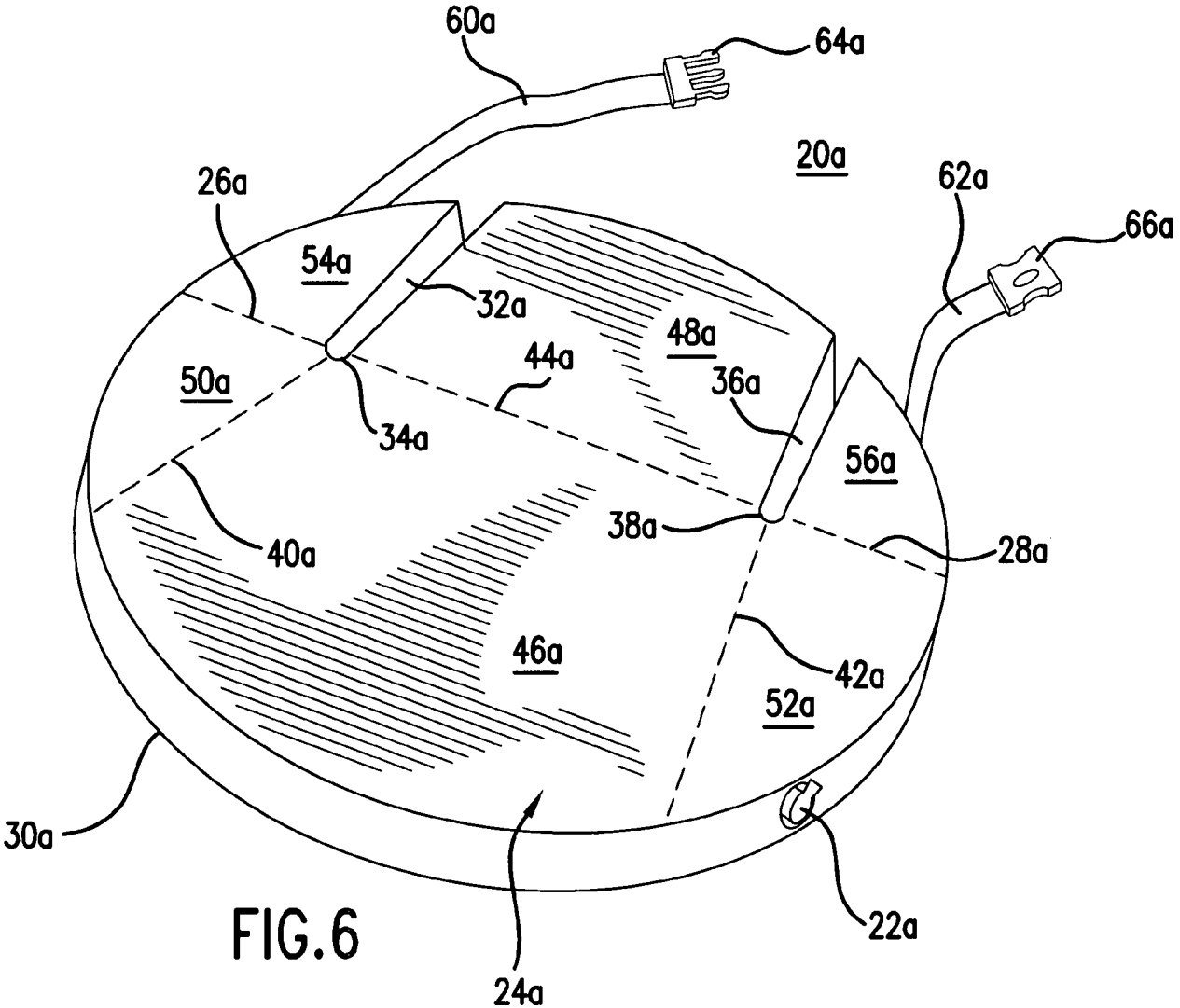
FIG. 6 is a perspective view of the inflatable seat of FIG. 4 shown fully inflated in a disassembled position.

FIGS. 4-6 illustrate another seat **20*a* according to the present invention. The seat 20*a* is very similar in construction to the seat 20 shown in FIGS. 1-3, so the same numeral designations shall be used to designate the same elements in FIGS. 1-3 and FIGS. 4-6, except that an "a" has been added to the designations in FIGS. 4-6**, and except for the differences noted below.

The body **24*a* differs from the body 24 in that (i) the grooves 32*a* and 36*a* in FIGS. 4-6 are now cut along the location of the fold lines 32 and 36, respectively, in FIGS. 1-3, and (ii) the fold lines 26*a* and 28*a* in FIGS. 4-6 are provided along the location of the grooves 26 and 28, respectively, in FIGS. 1-3. Thus, the fold line 44*a* can be co-linear with the fold lines 26*a* and 28*a*, and the fold lines 26*a* and 28*a* extend from the inner ends 34*a* and 38*a*, respectively, of the grooves 32*a* and 36*a*, respectively. In addition, the ends of the straps 60*a* and 62*a* are attached to the ends of the sections 54*a* and 56*a***, respectively.

The fully inflated body **24*a* that is shown in FIG. 6 can be assembled into the seat 20*a* by first folding the section 48*a* upwardly about the fold line 44*a*. Second, the sections 50*a* and 52*a* are folded upwardly about the fold lines 40*a* and 42*a*, respectively. The sections 54*a* and 56*a* are carried by the sections 50*a* and 52*a*, respectively, as they are folded. Third, the sections 54*a* and 56*a* are folded inwardly about the fold lines 26*a* and 28*a*, respectively. At this time, the body 24*a* will have been folded to assume the configuration shown in FIGS. 4 and 5. The buckle members 64*a* and 66*a* can be fastened to each other behind the section 48*a* to secure the body 24*a* in the desired seat configuration 20*a*. In this configuration, the sections 54*a* and 56*a* are folded inwardly behind the back rest section 48*a*, and do not intrude into the seating area of the seat 20*a*. The user can then use the seat 20*a*** in a conventional manner.

When it is desired to store or transport the seat **20*a*, the user first releases the buckle members 64*a*, 66*a*. Second, the user folds the sections 54*a* and 56*a* outwardly about the fold lines 26*a* and 28*a*, respectively. Third, the user folds the sections 48***a*, 50*a* and 52*a* downwardly about the respective fold lines 44*a*, 40*a* and 42*a* until the body 24*a* assumes the planar configuration shown in FIG. 6, where the body 24*a* can be easily and conveniently transported or stored.

Figure 7:
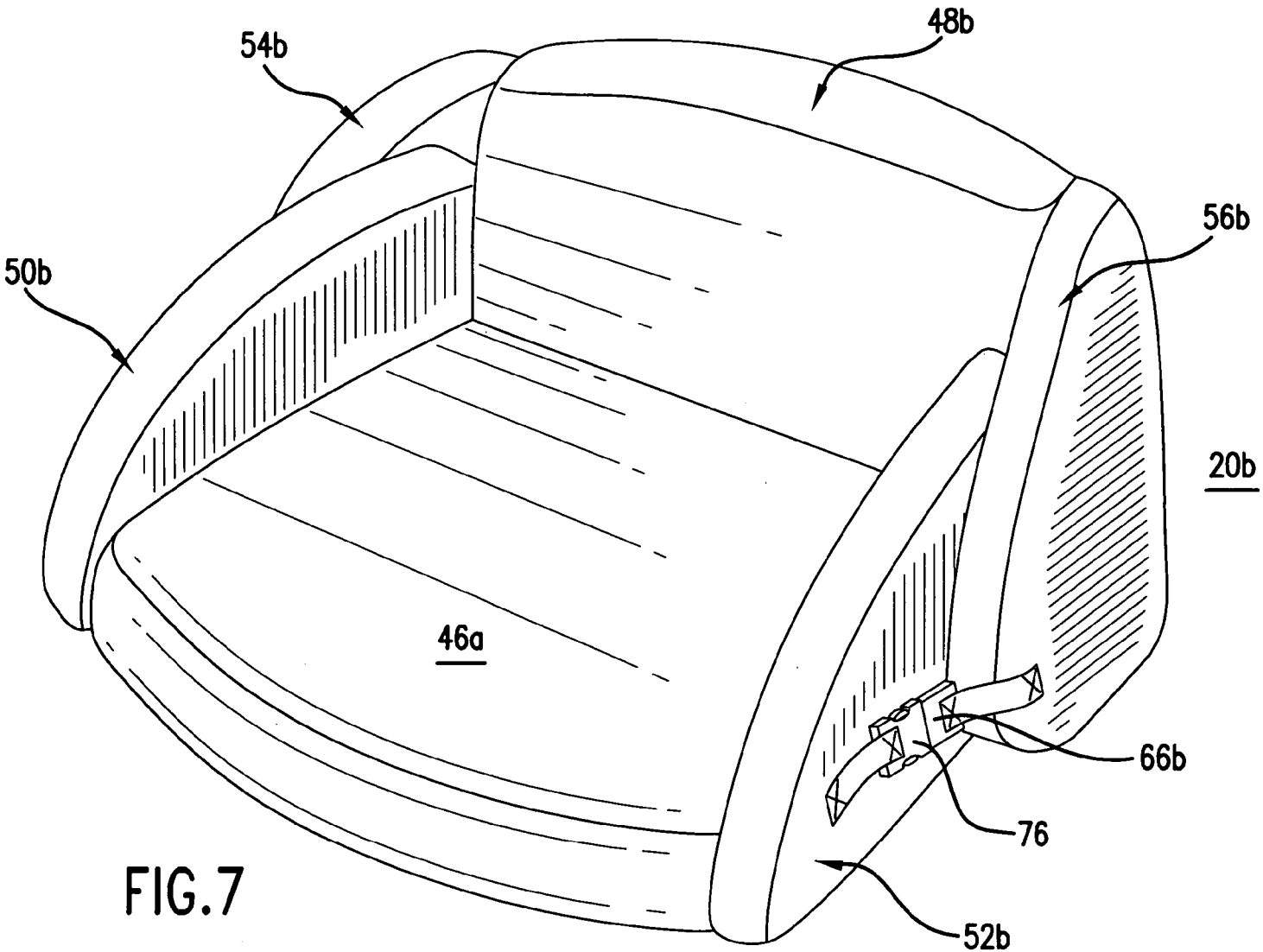
FIG. 7 is a front perspective view of an inflatable seat according to yet another embodiment of the present invention shown in the assembled position.
Figure 8:
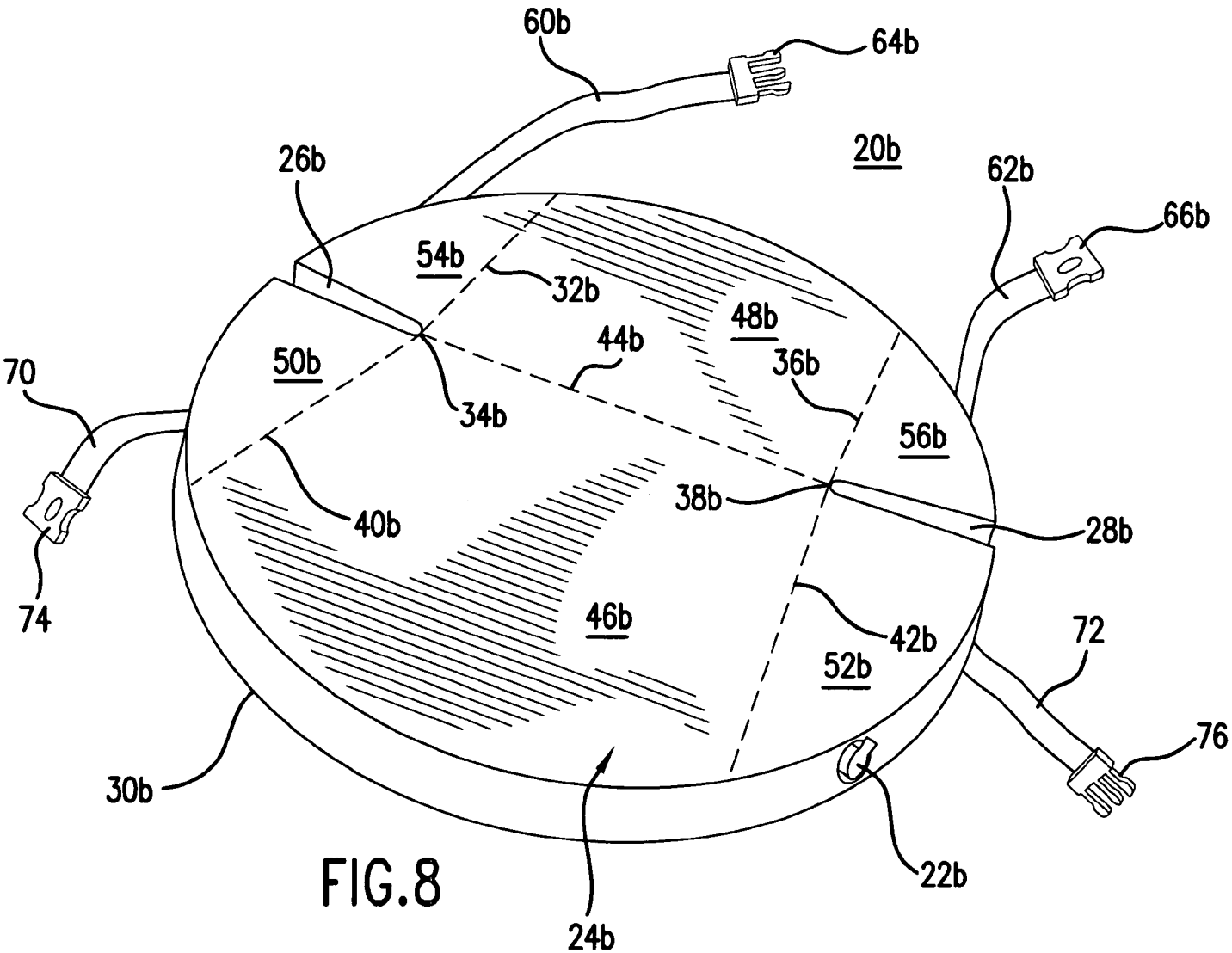
FIG. 8 is a perspective view of the inflatable seat of FIG. 7 shown fully inflated in a disassembled position.

FIGS. 7 and 8 illustrate another seat 20*b* according to the present invention. The seat 20*b* is very similar in construction to the seat 20 shown in FIGS. 1-3, so the same numeral designations shall be used to designate the same elements in FIGS. 1-3 and FIGS. 7-8, except that a "b" has been added to the designations in FIGS. 7-8, and except for the differences noted below.

The body 24*b* differs from the body 24 in that (i) the straps 60*b* and 62*b* are attached to the sections 54*b* and 56*b*, respectively, and (ii) an additional set of straps 70 and 72 (and corresponding buckle members 74 and 76) are attached to the sections 50*b* and 52*b*, respectively. In addition, the grooves 26*b* and 28*b* can be positioned slightly different, such as at the 9:00 o'clock and 3:00 o'clock positions along the circumferential edge 30 with respect to the longitudinal line L-L shown in FIG. 3.

The fully inflated body 24*b* that is shown in FIG. 8 can be assembled into the seat 20*b* by first folding the section 48*b* upwardly about the fold line 44*b*. The sections 54*b* and 56*b* are carried by the section 48*b* as it is folded. Second, the sections 50*b* and 52*b* are folded upwardly about the fold lines 40*b* and 42*b*, respectively. Third, the sections 54*b* and 56*b* are folded inwardly about the fold lines 32*b* and 36*b*, respectively, so that the sections 54*b* and 56*b* are external to the sections 50*b* and 52*b*, respectively. At this time, the body 24*b* will have been folded to assume the configuration shown in FIG. 7. The buckle members 64*b* and 74 can be fastened to each other to secure the section 54*b* outside the section 50*b*, and the buckle members 66*b* and 76 can be fastened to each other to secure the section 56*b* outside the section 52*b*, as shown in FIG. 7. In this configuration, the sections 54*b* and 56*b* are folded outside the sections 50*b* and 52*b*, and do not intrude into the seating area of the seat 20*b*. The user can then use the seat 20*b* in a conventional manner.

When it is desired to store or transport the seat 20*b*, the user first releases the two sets of buckle members 64*b*, 74 and 66*b*, 76. Second, the user folds the sections 54*b* and 56*b* outwardly about the fold lines 32*b* and 36*b*, respectively. Third, the user folds the sections 48*b*, 50*b*, 52*b* downwardly about the respective fold lines 44*b*, 40*b* and 42*b* until the body 24*b* assumes the planar configuration shown in FIG. 8, where the body 24*b* can be easily and conveniently transported or stored.

Figure 9:
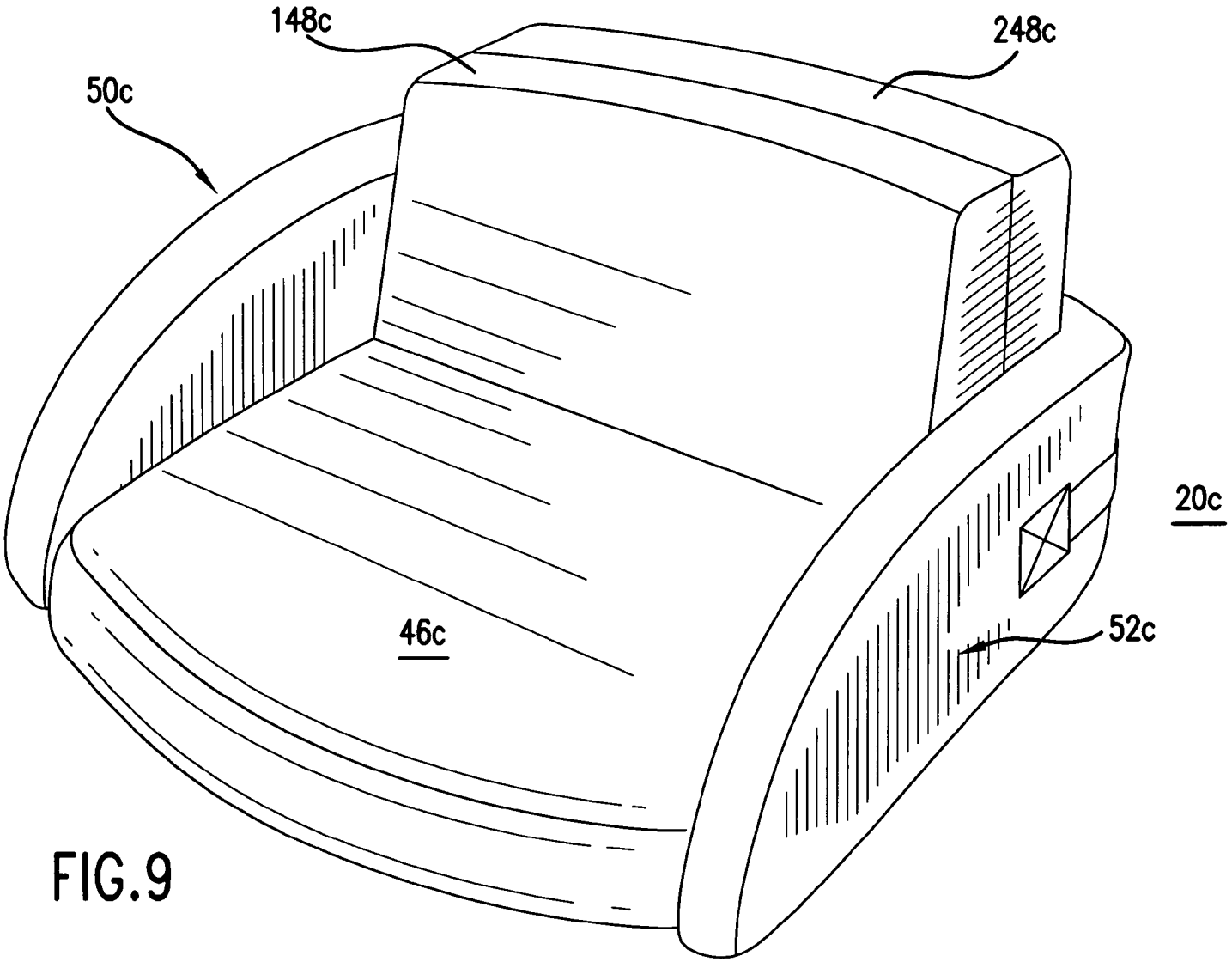
FIG. 9 is a front perspective view of an inflatable seat according to yet a further embodiment of the present invention shown in the assembled position.
Figure 10:
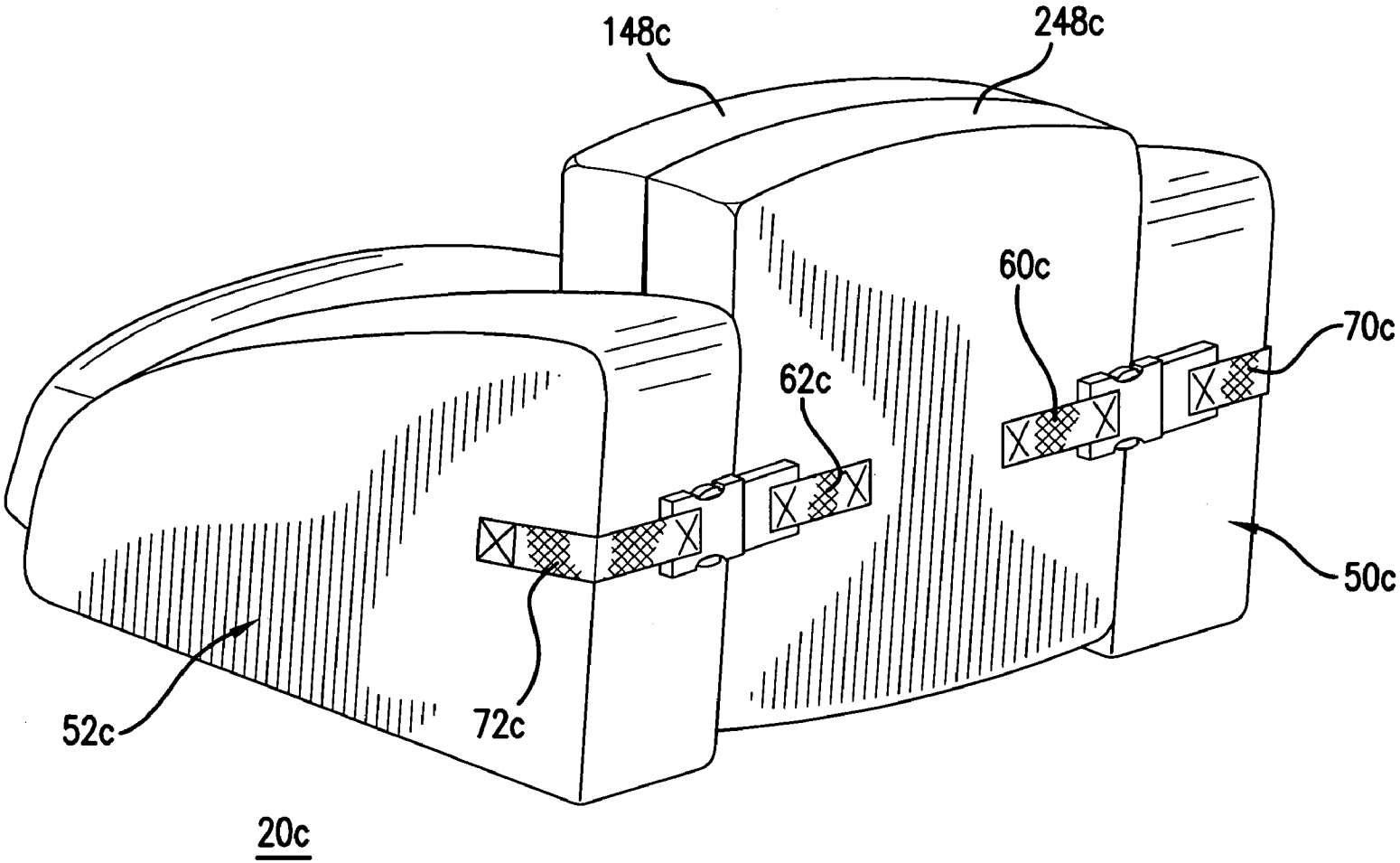
FIG. 10 is a rear perspective view of the inflatable seat of FIG. 9 shown in the assembled position.
Figure 11:
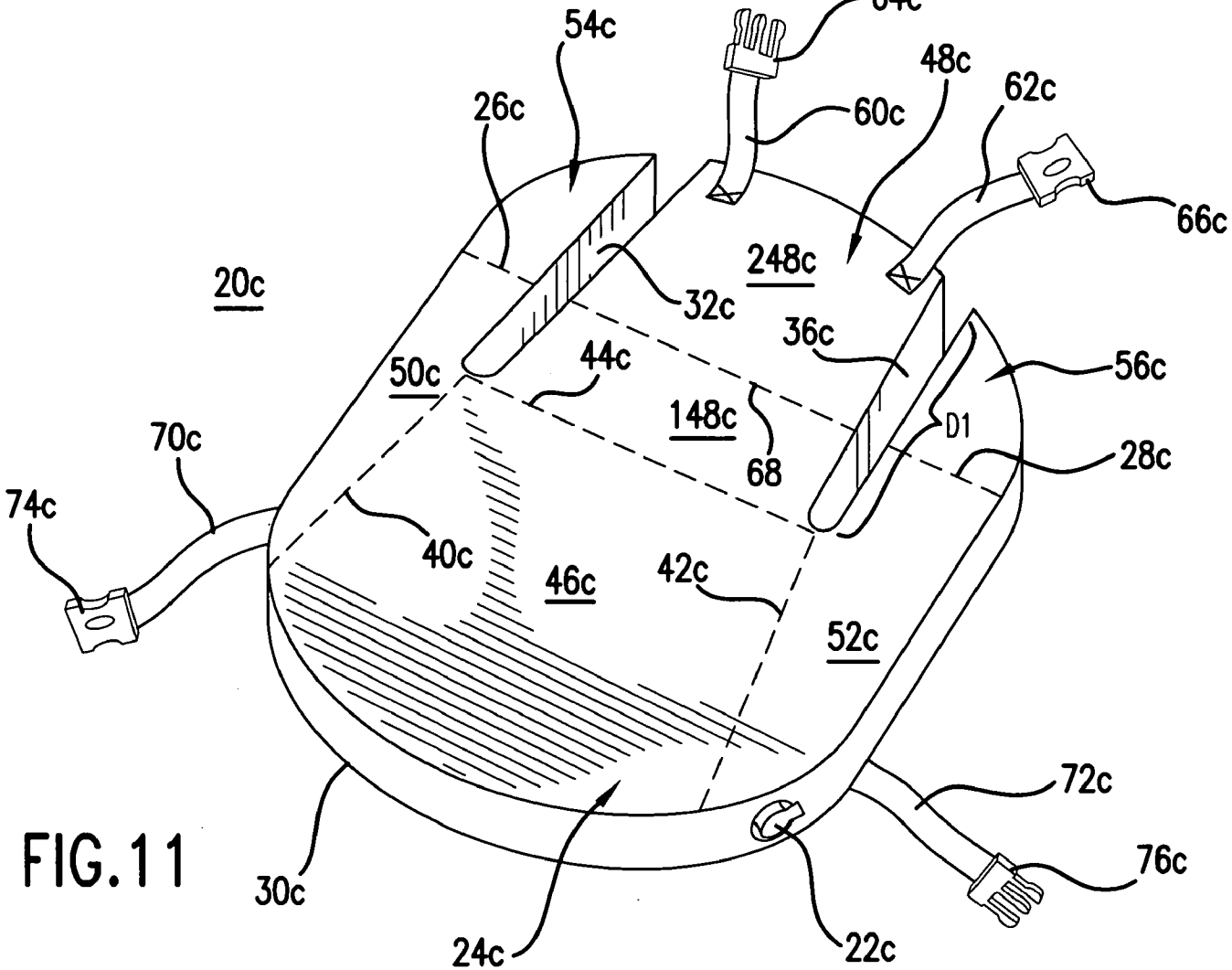
FIG. 11 is a perspective view of the inflatable seat of FIG. 9 shown fully inflated in a disassembled position.

FIGS. 9-11 illustrate another seat 20*c* according to the present invention. The seat 20*c* is very similar in construction to the seat 20*a* shown in FIGS. 4-6, so the same numeral designations shall be used to designate the same elements in FIGS. 4-6 and FIGS. 9-10, except that a "c" has been added to the designations in FIGS. 9-10 instead of the "a" used for the designations in FIGS. 4-6, and except for the differences noted below.

The body 24*c* is essentially the same as the body 24*a* except that the depth D1 of the grooves 32*c* and 36*c* has been lengthened, and the fold line 44*c* is positioned closer to the center of the body 24*c*. In addition, a sixth fold line 68 extends from one groove 32*c* to the other groove 36*c* along the approximate center of the section 48*c* to divide the section 48*c* into an inner section 148*c* that is defined by the grooves 32*c*, 36*c* and the fold lines 44*c*, 68, and an outer section 248*c* that is defined by the grooves 32*c*, 36*c*, the edge 30*c* and the fold line 68. The fold lines 26*c* and 28*c* extend from about the center of the grooves 32*c* and 36*c*, respectively, outwardly to the edge 30, and can be co-linear with the fold line 68. The ends of the straps 60*c* and 62*c* are attached to the outer section 248*c*, and the ends of the straps 70*c* and 72*c* are attached to the sections 50*c* and 52*c*, respectively.

The fully inflated body 24*c* that is shown in FIG. 11 can be assembled into the seat 20*c* by first folding the section 48*c* (i.e., the inner section 148*c* and the outer section 248*c*) upwardly about the fold line 44*c*. Second, the outer section 248*c* is folded downwardly about the fold line 68. Third, the sections 50*c* and 52*c* are folded upwardly about the fold lines 40*c* and 42*c*, respectively. The sections 54*c* and 56*c* are carried by the sections 50*c* and 52*c*, respectively, as they are folded. Fourth, the sections 54*c* and 56*c* are folded inwardly about the fold lines 26*c* and 28*c*, respectively. At this time, the body 24*c* will have been folded to assume the configuration shown in FIG. 9. The buckle members 64*c* and 74*c* can be fastened to each other behind the outer section 248*c*, and the buckle members 66*c* and 76*c* can be fastened to each other behind the outer section 248*c*, to secure the body 24*c* in the desired seat configuration 20*c*. In this configuration, the section 48*c* is divided into an inner section 148*c* and an outer section 248*c* that together form a thicker back rest section 48*c*. The user can then use the seat 20*c* in a conventional manner.

When it is desired to store or transport the seat 20*c*, the user first releases the two sets of buckle members 64*c*+74*c* and 66*c*+76*c*. Second, the user folds the sections 54*c* and 56*c* outwardly about the fold lines 26*c* and 28*c*, respectively. Third, the user folds the outer section 248*c* upwardly about the fold line 68. Fourth, the user folds the sections 48*c* (combined sections 148*c*, 248*c*), 50*c* and 52*c* downwardly about the respective fold lines 44*c*, 40*c* and 42*c* until the body 24*c* assumes the planar configuration shown in FIG. 10, where the body 24*c* can be easily and conveniently transported or stored.

Figure 12:
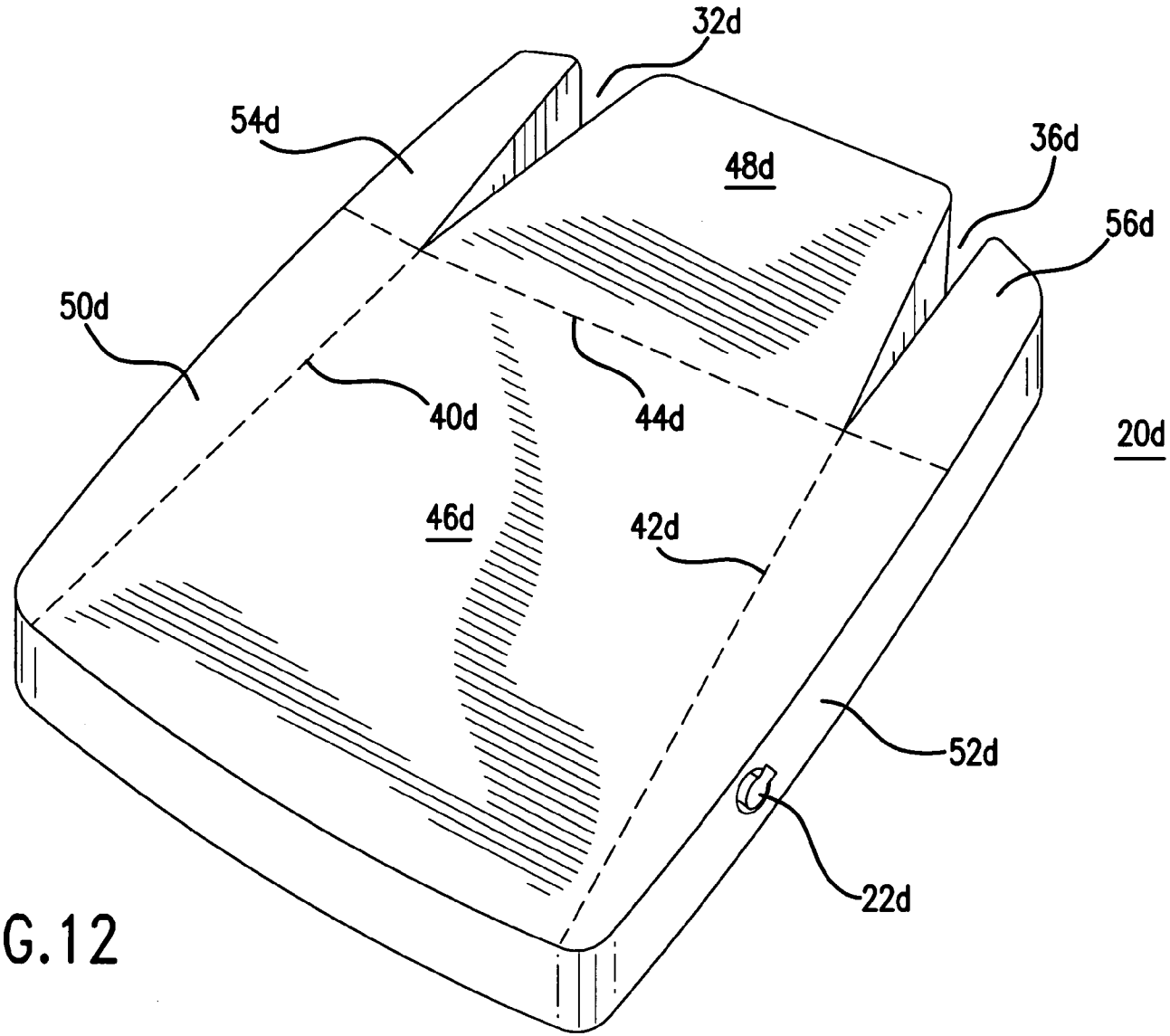
FIGS. 12-14 are perspective view of the inflatable seat of FIG. 6 shown fully inflated in a disassembled position, and assuming different shapes.

Although the body 24 is illustrated in the various embodiments as being generally circular, this is merely a non-limiting example, as the body 24 can assume a different configuration. As one non-limiting example, FIG. 12 illustrates how the seat 20*a* in FIG. 6 can be modified to assume a four-sided configuration. The seat 20*d* in FIG. 12 is the same as the seat 20*a* shown in FIGS. 4-6 except that the seat 20*d* has a four-sided configuration, so the same numeral designations shall be used to designate the same elements in FIGS. 4-6 and FIG. 12, except that a "d" has been added to the designations in FIG. 12.

Figure 13:
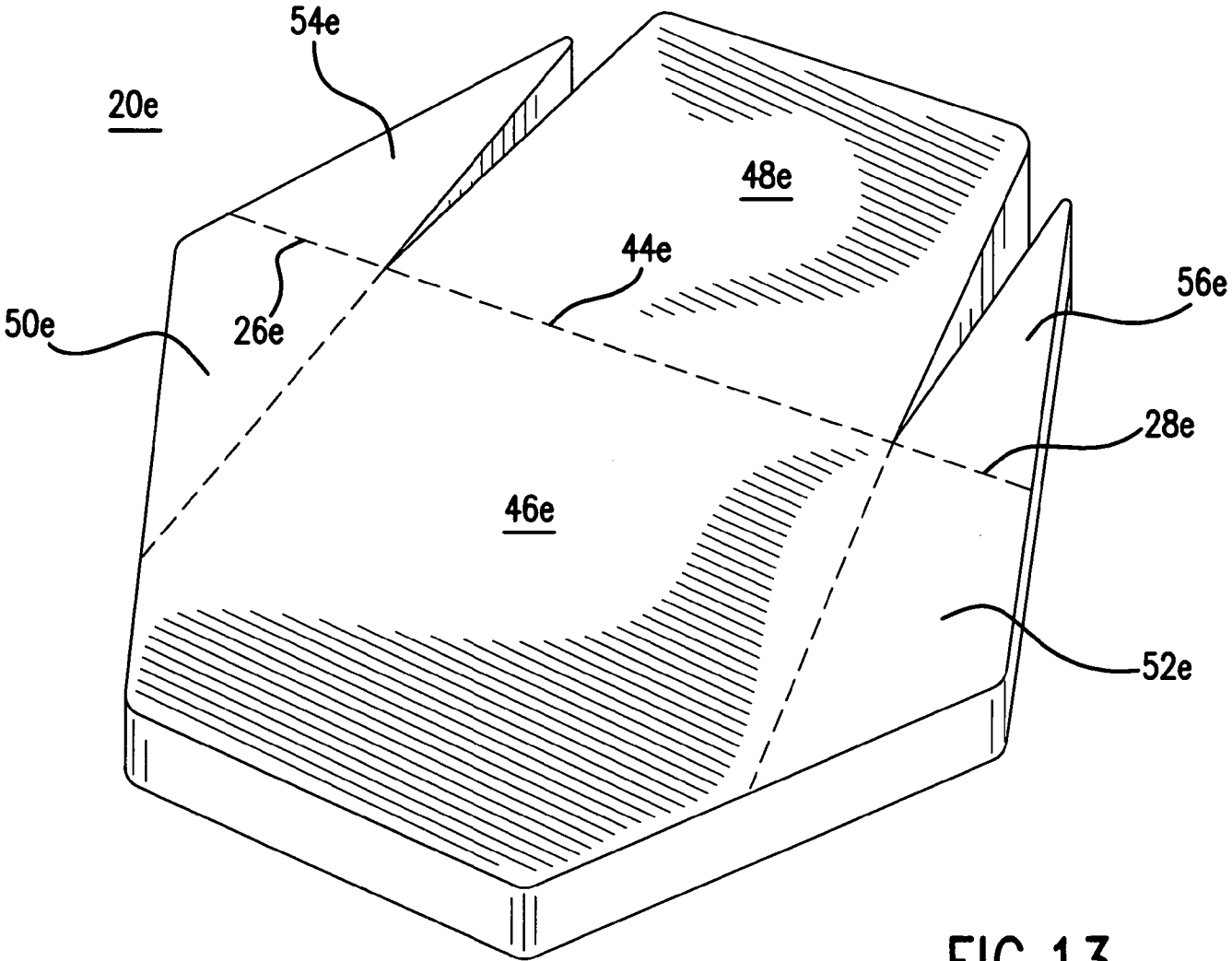

Similarly, FIG. 13 illustrates how the seat 20*a* in FIG. 6 can be modified to assume an polygonal (six-sided) configuration. The seat 20*e* in FIG. 13 is the same as the seat 20*a* shown in FIGS. 4-6 except that the seat 20*e* has a six-sided configuration, so the same numeral designations shall be used to designate the same elements in FIGS. 4-6 and FIG. 13, except that an "e" has been added to the designations in FIG. 13.

Figure 14:
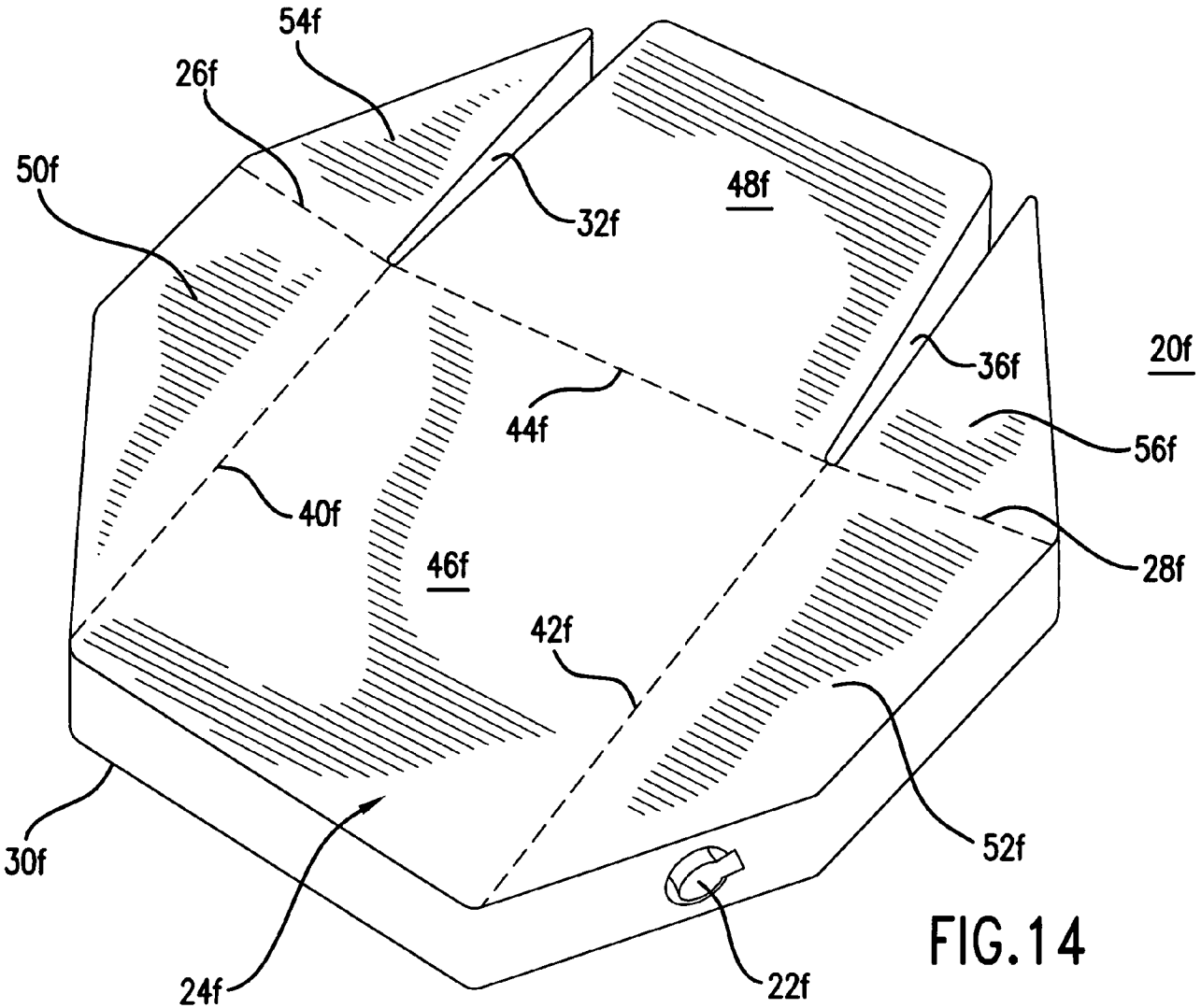

As yet another example, FIG. 14 illustrates how the seat 20*a* in FIG. 6 can be modified to assume an octagonal configuration. The seat 20*f* in FIG. 14 is the same as the seat 20*a* shown in FIGS. 4-6 except that the seat 20*f* has an eight-sided configuration, so the same numeral designations shall be used to designate the same elements in FIGS. 4-6 and FIG. 14, except that an "f" has been added to the designations in FIG. 14.

In addition, although the present invention has described the use of releasable buckles carried on straps, it is also possible to use other known releasable attachment mechanisms, such as but not limited to opposing VELCRO™ straps, hooks, and the like.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An inflatable item, comprising:

a body having a chamber therein, the body defining an outer edge;

an inlet provided on the body and communicating with the chamber;

a first groove cut from the outer edge of the body and extending for a depth into the body;

a second groove cut from the outer edge of the body and extending for a depth into the body;

a first fold line extending from the outer edge to a portion of the first groove; and a second fold line extending from the outer edge to a portion of the second groove.

2. The item of claim 1, wherein the body defines a longitudinal center line, and wherein the first and second grooves are symmetrical to each other about the center line.

3. The item of claim 1, wherein the body defines a longitudinal center line, and wherein the first and second fold lines are symmetrical to each other about the center line.

4. The item of claim 1, wherein the first groove has an inner end, with the first fold line extending from the outer edge to the inner end of the first groove.

5. The item of claim 1, wherein the first fold line divides the body into separate first and second sections.

6. The item of claim 5, wherein the second fold line divides the body into separate first and third sections.

7. The item of claim 5, wherein the body assumes a planar configuration when fully inflated, and wherein the body assumes a folded configuration when the separate sections are folded about the fold lines.

8. The item of claim 7, further including a releasable attachment mechanism that secures the body in the folded configuration.

9. The item of claim 1, further including a third fold line extending from a portion of the first groove to a portion of the second groove.

10. The item of claim 1, further including:

a third fold line extending from the outer edge to another portion of the first groove; and a fourth fold line extending from the outer edge to another portion of the second groove.

11. The item of claim 1, wherein the body is generally circular.

12. The item of claim 1, wherein the body has four sides.

13. A method of deploying an inflatable item, comprising:

a. providing a body defining an outer edge, the body having:

a chamber therein;

an inlet provided on the body and communicating with the chamber;

first and second grooves cut from the outer edge of the body and extending for a depth into the body; and a first fold line extending from the outer edge to a portion of the first groove, the first fold line dividing the body into separate sections, a second fold line extending from the outer edge to a portion of the second groove;

b. inflating the chamber with the body in a planar configuration;

c. folding the body about the first fold line so that the body assumes a folded configuration while the body is still inflated; and d. folding the body about the second fold line.

14. The method of claim 13, further including:

d. securing the body in the folded configuration.

* * * * *